United States Patent [19]

Frindel et al.

[11] Patent Number: 5,011,368

[45] Date of Patent: Apr. 30, 1991

[54] VACUUM PUMP OF THE TYPE HAVING A GAEDE CHANNEL

[75] Inventors: Sébastien Frindel, Annecy le Vieux; Luc Mathieu, Annecy, both of France

[73] Assignee: Alcatel Cit, Paris, France

[21] Appl. No.: 461,895

[22] Filed: Jan. 8, 1990

[30] Foreign Application Priority Data

Jan. 9, 1989 [FR] France ..... 89 00152

[51] Int. Cl.[5] ..... F01D 1/36

[52] U.S. Cl. ..... 415/90; 415/131; 417/361

[58] Field of Search ..... 415/71, 73, 90, 131; 417/361, 423.4

[56] References Cited

U.S. PATENT DOCUMENTS

| | | | |
|---|---|---|---|
| 651,400 | 6/1900 | Trouve et al. | 415/90 |
| 1,810,083 | 6/1931 | Norinder | 415/90 |
| 2,001,800 | 5/1935 | Silbermann | 415/73 |
| 2,730,297 | 1/1956 | Van Dorsten et al. | 415/90 |
| 3,666,374 | 5/1972 | Becker | 415/90 |
| 4,642,036 | 2/1987 | Young | 415/90 |

FOREIGN PATENT DOCUMENTS

| | | |
|---|---|---|
| 912007 | 5/1954 | Fed. Rep. of Germany . |
| 1293546 | 4/1962 | France . |

*Primary Examiner*—Edward K. Look
*Assistant Examiner*—James A. Larson
*Attorney, Agent, or Firm*—Sughrue, Mion, Zinn, Macpeak & Seas

[57] ABSTRACT

A vacuum pump of the type having a Gaede channel, the pump comprising a stator (1) and a rotor (2) driven to rotate inside the stator, the stator including a suction inlet (12) and a delivery outlet (13). The active portion of the rotor situated between the suction inlet and the delivery outlet is hemispherical in shape (9) and is disposed inside a cavity (10) of the stator which is likewise hemispherical in shape. The axis δ of said rotor coincides with the said axis of the hemispherical cavity of the stator. Suction takes place at the large circle end of the hemispherical rotor via radial clearance $j_a$ between the rotor and the stator, and delivery takes place at the pole end of the hemispherical rotor. An adjustment distance piece (14) for axially positioning the rotor (2) relative to the stator (1) is provided so that the radial delivery clearance $j_r$ is smaller than the radial suction clearance $j_a$.

4 Claims, 2 Drawing Sheets

VACUUM PUMP OF THE TYPE HAVING A GAEDE CHANNEL

The present invention relates to a vacuum pump of the type having a Gaede channel, the pump comprising a stator and a rotor driven to rotate inside the stator, the stator having a suction inlet and a delivery outlet.

BACKGROUND OF THE INVENTION

Pumps of this type are well known and are referred to as Holweck pumps or as Gaede channel pumps. In pumps of this type, the rotor is in the form of a disk or a circular cylinder, or of a cone, and its surface is provided with at least one helical groove, while the facing surface of the stator is smooth, or alternatively, as is more commonly the case, it is on the contrary the surface of the rotor which is smooth and the surface of the stator which has grooves. Sometimes, both facing surfaces have such grooves. The depth of these grooves generally decreases going from the suction end to the delivery end.

In order to obtain good performance, it is important to reduce the operating clearance between the rotor and the stator to as small a value as possible, and this means that the rotor and the stator must be made very accurately. It is difficult to obtain very high accuracy in shape with prior art pumps.

German patent document number 912 007 describes a pump of this type but having a rotor which is spherical. This is most advantageous in that spherical surfaces can be made with very high accuracy, better than 1000th of a millimeter, by machining using a milling cutter or a cup wheel, or by molding, thereby reducing operating clearances.

The object of the present invention is to improve a pump of this type by increasing its compression ratio.

SUMMARY OF THE INVENTION

The present invention thus provides a vacuum pump of the type having a Gaede channel, the pump comprising a stator and a rotor driven to rotate inside the stator, the stator having a suction inlet and a delivery outlet, wherein the active portion of said rotor situated between the suction inlet and the delivery outlet is constituted by two hemispherical portions which are interconnected by a central cylindrical portion, the rotor being disposed in a rotor cavity likewise comprising two hemispherical cavities interconnected by an intermediate portion corresponding to the cylindrical portion of the rotor and through which admission takes place, the center of each hemispherical portion of the rotor being offset relative to the center of the corresponding hemispherical cavity of the stator in such a manner that the radial clearance $j_a$ at the suction end level with the large circles of the hemispheres is greater than the radial clearance $j_r$ at the delivery end situated, for each of the hemispheres, in the vicinity of the pole of the hemisphere, with the axis of rotation $\delta$ or the rotor coinciding with the axis passing through the centers of the two large circles of the hemispherical cavities in the stator.

In another aspect, the present invention provides a vacuum pump of the type having a Gaede channel, the pump comprising a stator and a rotor driven to rotate inside the stator, the stator including a suction inlet and a delivery outlet, wherein the active portion of the rotor situated between the suction inlet and the delivery outlet is hemispherical in shape and is disposed inside a cavity of the stator which is likewise hemispherical in shape, the axis $\delta$ of said rotor coinciding with the axis of the hemispherical cavity of the stator, suction taking place at the large circle end of the hemispherical rotor via radial clearance $j_a$ between the rotor and the stator, and delivery taking place at the pole end of the hemispherical rotor, an adjustment distance piece for axially positioning the rotor relative to the stator being provided so that the radial delivery clearance $j_r$ is smaller than the radial suction clearance $j_a$.

Advantageously, said distance piece includes axial adjustment means to enable the radial clearance between the stator and the rotor to be adjusted at the delivery end by varying the axial offset between the center; of the rotor and the center of the stator.

For example, said distance piece is rotatable and includes slopes co-operating with balls.

BRIEF DESCRIPTION OF THE DRAWINGS

Embodiments of the invention are described by way of example with reference to the accompanying drawings, in which.

DETAILED DESCRIPTION

Figure 1:
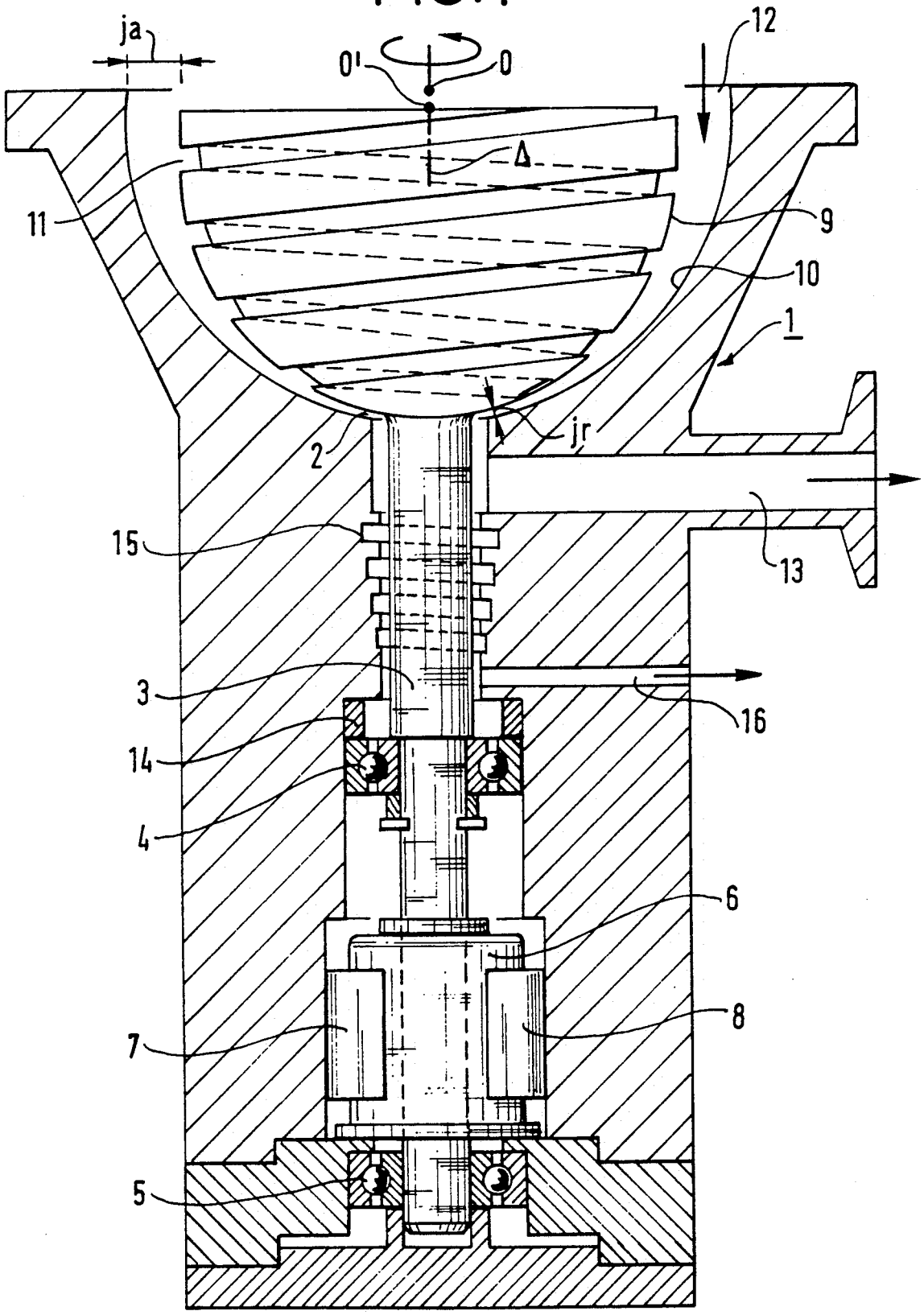
FIG. 1 is a diagrammatic axial section view through a vacuum pump of the invention.

With reference to FIG. 1, there can be seen a vacuum pump of the invention comprising a stator 1 and a rotor 2. The rotor 2 includes a shaft 3 whereby it is supported inside the stator 2 by means of bearings 4 and 5. The rotor 2 is rotated by means of a motor 6 fixed inside the stator via blocks 7 and 8. The active portion of the rotor 9 is hemispherical in shape and is situated in a cavity 10 of the stator which is likewise hemispherical. The axis $\delta$ of the rotor coincides with the axis of the hemispherical cavity of the stator.

The surface of the rotor has a helical groove 11 formed therein with the depth of the groove decreasing from the suction end 12 situated adjacent to the large circle of the hemisphere towards the delivery end 13 situated adjacent to the pole of the hemisphere. As shown in FIG. 1, the representation of the pump is diagrammatic, and in fact there are several helical grooves 11. These grooves need not necessarily be formed in the rotor, but they could be formed in the stator cavity, or indeed they could be formed both in the rotor and in the stator. As can be seen in the figure, the center O' of the rotor is axially offset from the center O of the hemispherical cavity of the stator such that the radial clearance $j_a$ at the suction end is greater than the radial clearance $j_r$ at the delivery end. The ratio between these clearances $j_r$ and $j_a$ is accurately adjusted by means of a distance piece 14. This makes it possible to improve the compression ratio which is given by an expression of the form $K(R^2/r^2)$ where R and r are respectively the radius of the rotor at its suction end and at its delivery end, and K is a constant depending on parameters, and in particular on the ratio $(j_r/j_a)$. The value of K increases with a reduction in the value of the ratio $(j_r/j_a)$. By way of example, $j_a$ may have the value of 0.1 mm to 0.2 mm, while $j_r$ has a value of about 0.01 mm. This greatly improves the compression ratio compared with a spherical pump having constant clearance.

The value of K is also increased by reducing the depth of the helical grooves 11 from the suction end towards the delivery end.

A dynamic seal having a groove 15 provides dynamic sealing between the stator 10 and the shaft 3 of the rotor downstream from the delivery 13, and upstream from the first bearing 4. An orifice 16 is provided downstream from the dynamic seal.

Figure 2:
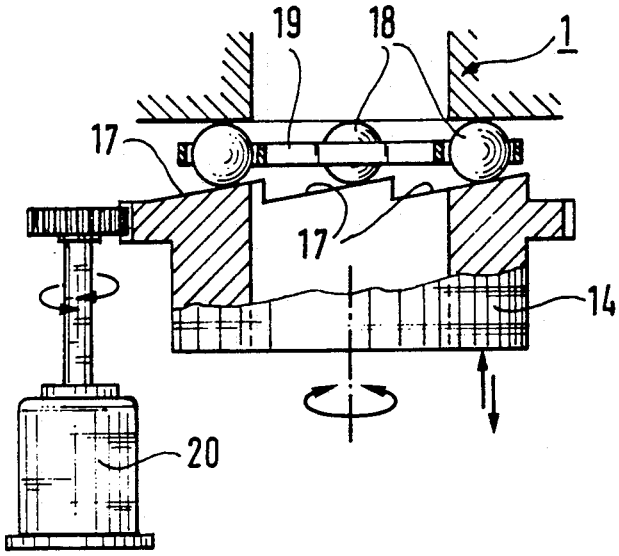
FIG. 2 shows a detail of a particular arrangement.

FIG. 2 is a detail showing an embodiment in which the distance member 14 is adjustable, thereby enabling the delivery clearance $j_r$ to be varied. In this case, the distance member 14 includes sloping surfaces 17 associated with balls 18 held in a cage 19. The distance member is rotated for adjustment purposes by means of a motor 20.

Figure 3:
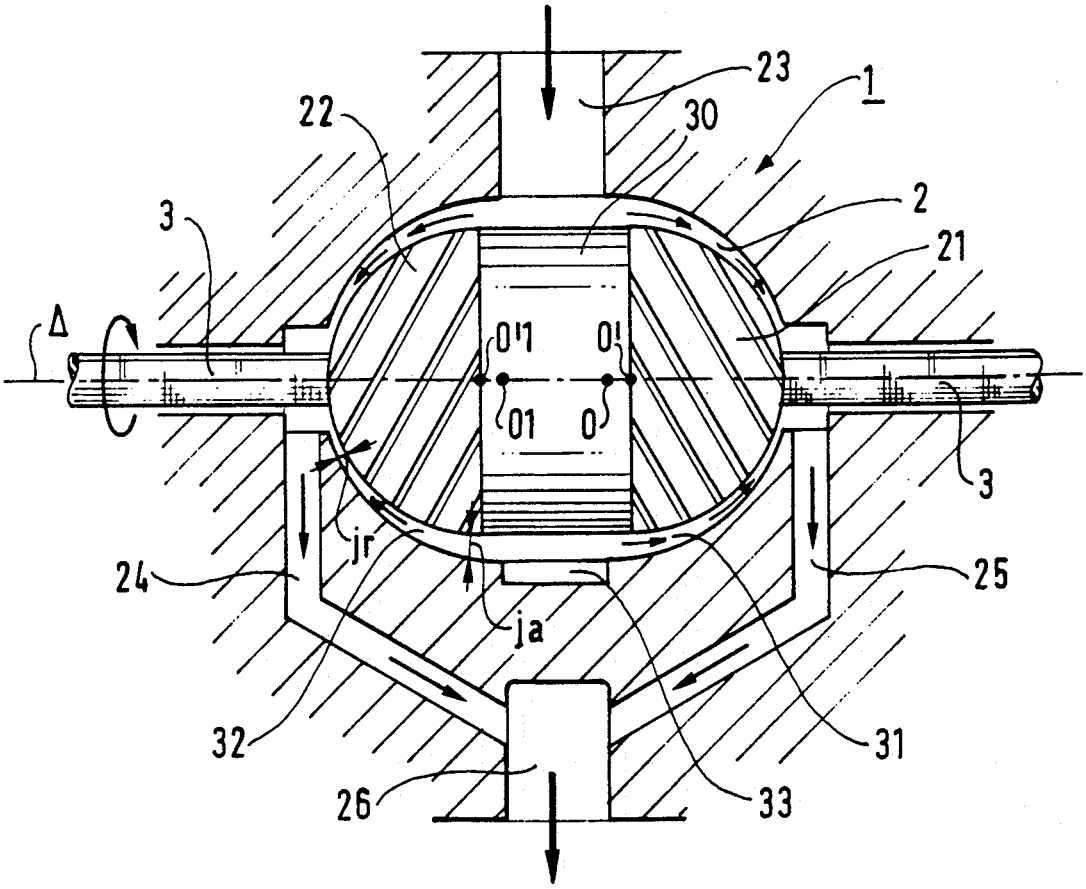
FIG. 3 is a diagrammatic view of a second embodiment of the invention.

FIG. 3 shows a variant in which the rotor 2 has two active portions and is therefore constituted by two hemispherical portions 21 and 22 interconnected by a central cylindrical portion 30. In this case there are effectively two pumps, with the central portion 30 serving to off-center the two hemispherical portions 21 and 22 of the rotor relative to the two hemispherical cavities 31 and 32 in the stator. The axis $\delta$ of the rotor coincides with the axis interconnecting the centers O and $O_1$ of the two large circles of the hemispherical cavities of the stator. The hemispherical cavities 31 and 32 are interconnected by an intermediate portion 33 constituting an admission ring. The admission 23 is situated in the middle and the flow entering thereby splits to left and to right, with the deliveries 24 and 25 from each of the two portions being recombined at 26. This disposition makes it possible, approximately, to double the throughput of the pump.

By way of example, the following numerical values are appropriate for a pump as shown in FIG. 1:

The compression ratio varies from about 25 to about 300 depending on the value of the ratio ($j_a/j_r$).

Its throughput lies in the range 0.3 liters per second (l/s) to 2.7 l/s for rotors whose large diameter lies in the range 100 mm to 300 mm, and rotating at 24,000 revolutions per minute (rpm).

In order to increase the compression ratio, it is easy to build up a pump having two compression stages or even more.

For a two-stage pump, the compression ratio may be as much as $9.10^4$.

In addition, in order to increase throughput, the rotor may be provided with a leading finned wheel.

The present pump continues to have the normal advantages associated with dry pumps.

We claim:

1. A vacuum pump of the type having a Gaede channel, the pump comprising a stator and a rotor driven to rotate inside the stator, the stator including a suction inlet and a delivery outlet, wherein the active portion of the rotor situated between the suction inlet and the delivery outlet is hemispherical in shape and is disposed inside a cavity of the stator which is likewise hemispherical in shape, the axis of rotation $\delta$ of said rotor coinciding with the axis of the hemispherical cavity of the stator, suction taking place at the large circle end of the hemispherical rotor via radial clearance $j_a$ between the rotor and the stator, and delivery taking place at the pole end of the hemispherical rotor, an adjustment distance piece for axially positioning the rotor relative to the stator being provided so that the radial delivery clearance $j_r$ is smaller than the radial suction clearance $j_a$.

2. A vacuum pump according to claim 1, wherein said distance piece includes axial adjustment means to enable the radial clearance between the stator and the rotor to be adjusted at the delivery end by varying the axial offset between the center of curvature of the rotor and the center of curvature of the stator.

3. A vacuum pump according to claim 2, wherein said distance piece is rotatable and includes slopes cooperating with balls.

4. A vacuum pump of the type having a Gaede channel, the pump comprising a stator and a rotor driven to rotate inside the stator, the stator having a suction inlet and a delivery outlet, wherein the active portion of said rotor situtated between the suction inlet and the delivery outlet is constituted by two hemispherical portions which are interconnected by a central cylindrical portion, the rotor being disposed in a rotor cavity likewise comprising two hemispherical cavities interconnected by an intermediate portion corresponding to the cylindrical portion of the rotor and through which admission takes place, the center of curvature of each hemispherical portion of the rotor being offset relative to the center of curvature of the corresponding hemispherical cavity of the stator in such a manner that the radial clearance $j_a$ at the suction end level with the large circles of the hemispheres is greater than the radial clearance $j_r$ at the delivery end situated, for each of the hemispheres, in the vicinity of the pole of the hemisphere, with the axis of rotation $\delta$ of the rotor coinciding with the axis passing through the centers of curvature of the two large circles of the hemispherical cavities in the stator.

* * * * *